US008739936B2

(12) United States Patent
Kostka et al.

(10) Patent No.: US 8,739,936 B2
(45) Date of Patent: Jun. 3, 2014

(54) ELEVATOR CONTROL OF AN ELEVATOR INSTALLATION

(75) Inventors: Miroslav Kostka, Ballwil (CH); Paul Friedli, Remetschwil (CH)

(73) Assignee: Inventio AG, Hergiswil (CH)

( * ) Notice: Subject to any disclaimer, the term of this patent is extended or adjusted under 35 U.S.C. 154(b) by 520 days.

(21) Appl. No.: 13/142,289

(22) PCT Filed: Dec. 18, 2009

(86) PCT No.: PCT/EP2009/067476

§ 371 (c)(1),
(2), (4) Date: Jun. 27, 2011

(87) PCT Pub. No.: WO2010/072660

PCT Pub. Date: Jul. 1, 2010

(65) Prior Publication Data

US 2011/0272220 A1 Nov. 10, 2011

(30) Foreign Application Priority Data

Dec. 26, 2008 (EP) ..... 08172950

(51) Int. Cl.
*B66B 9/00* (2006.01)
*B66B 1/24* (2006.01)

(52) U.S. Cl.
CPC ..... *B66B 1/2433* (2013.01); *B66B 1/2466* (2013.01)
USPC ..... 187/249; 187/391

(58) Field of Classification Search
CPC ..... B66B 1/24; B66B 1/2433; B66B 1/2466
USPC ..... 187/247, 249, 380–388, 391–394
See application file for complete search history.

(56) References Cited

U.S. PATENT DOCUMENTS

| | | | | |
|---|---|---|---|---|
| 5,663,538 | A | 9/1997 | Sakita | |
| 5,877,462 | A * | 3/1999 | Chenais | 187/249 |
| 7,353,912 | B2 * | 4/2008 | Reuter et al. | 187/249 |
| 7,448,471 | B2 * | 11/2008 | Nuebling | 187/286 |
| 7,819,228 | B2 * | 10/2010 | Terry et al. | 187/249 |
| 8,136,635 | B2 * | 3/2012 | Christy et al. | 187/249 |
| 8,297,409 | B2 * | 10/2012 | Hsu et al. | 187/249 |
| 8,356,697 | B2 * | 1/2013 | Kriss et al. | 187/249 |
| 8,424,650 | B2 * | 4/2013 | Brand | 187/249 |
| 8,424,651 | B2 * | 4/2013 | Brand | 187/249 |
| 8,434,599 | B2 * | 5/2013 | Wang et al. | 187/249 |
| 2007/0089935 | A1 | 4/2007 | Hikita | |

FOREIGN PATENT DOCUMENTS

| | | | |
|---|---|---|---|
| EP | 1619157 | A1 | 1/2006 |
| WO | 2008079147 | A1 | 7/2008 |
| WO | 2008120849 | A1 | 10/2008 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator control of an elevator installation having at least two elevator cars movable independently of one another in a common elevator includes a control device for maintaining a defined minimum distance between two successive ones of the elevator cars and a defined maximum distance between two successive ones of the elevator cars.

13 Claims, 2 Drawing Sheets

10 elevator installation
12 control apparatus
14 shaft
16 shaft
18 shaft
20 car
22 car
24 car
26 car
28 car
30 car
32 car
34 car
36 car
38 travel direction
40 travel direction
42 travel direction
44 travel request
46 floor selection
48 floor selection
50 floor selection
56 shaft door 10 elevator installation
12 control apparatus
14 shaft
16 shaft
18 shaft
20 car
22 car
24 car
26 car
28 car
30 car
32 car
34 car
36 car
38 travel direction
40 travel direction
42 travel direction
44 travel request
46 floor selection
48 floor selection
50 floor selection
56 shaft door 10' elevator installation
12' control apparatus
16' shaft
26' car
28' car
30' car
40' travel direction
56' shaft door
58' destination call
60' keyboard

ELEVATOR CONTROL OF AN ELEVATOR INSTALLATION

FIELD OF THE INVENTION

The invention relates to an elevator control of an elevator installation and to a method of controlling an elevator installation.

BACKGROUND OF THE INVENTION

An elevator installation with an elevator control, several elevator shafts and several, individually movable elevator cars is known from the specification EP 1 619 157 A1, wherein at least two of the elevator cars are loaded and unloaded simultaneously in at least two so-termed access regions lying directly one above the other and these at least two elevator cars subsequently serve individually allocated destination calls.

The specification US 2007/0089935 A1 discloses an elevator control for several elevator cars individually movable in a travel shaft, which elevator control for avoidance of a collision prevents travel of two elevator cars in direction towards one another in that one of the elevator cars is moved to a waiting position.

SUMMARY OF THE INVENTION

The invention is based on the task, in particular, of providing an elevator control of an elevator installation which with a high level of reliability and a high transport capacity can be of simple design.

The invention proceeds from an elevator control of an elevator installation with at least two elevator cars, which are provided for the purpose of being moved independently of one another in a common travel shaft, and with a control apparatus.

By "control apparatus" there is to be understood, in particular, apparatus with a computer unit, a memory unit and an operating program stored therein. By "control" there is to be understood in this connection a selective actuation in a pure control sequence and/or also in a regulating sequence. Through maintenance of the common travel direction for the elevator cars of a travel shaft it is advantageously possible to avoid priority conflicts which could lead to undesired stoppage times. An elevator control for an elevator installation can be provided which with a high level of reliability and a high transport capacity can be of simple design.

It is proposed that the control apparatus is provided for the purpose of maintaining a defined minimum spacing between each two elevator cars following one another and/or a defined maximum spacing between each two elevator cars following one another.

The minimum spacing to be maintained can advantageously be determined, by way of example, in the manner taught in the specification EP 0 769 469 B1. The maximum spacing to be maintained is preferably freely selectable. Through maintenance of the minimum spacing between two elevator cars following one another it is advantageously possible to avoid situations which due to the maintenance of necessary safety measures would lead to undesired stoppage times of the elevator cars. Through maintenance of the maximum spacing between the elevator cars a determined travel direction of the elevator cars can be kept over a longer period of time than without this maintenance, whereby with particular advantage priority conflicts can be avoided, which would lead to an increase in the transport capacity of the elevator installation.

The maximum spacing between each two elevator cars following one another is determinable on the basis of different criteria and depends on, for example, the length of the travel path, particularly the height of the elevator shaft, the number of elevator cars movable on a travel path and the speed at which the elevator cars are moved.

Moreover, it is proposed that the control apparatus is provided for the purpose, in the case of loading of a first elevator car of two elevator cars following one another, of influencing at least one travel parameter of the second elevator car for maintenance of the defined minimum spacing and for maintenance of the defined maximum spacing of the elevator cars. Advantageously, the maintenance of the defined minimum and/or maximum spacing of elevator cars following one another can thereby be achieved in particularly simple manner.

By "travel parameter" there is to be understood in this connection, in particular, a variable which has an influence on a total time required by the elevator car for processing a call, particularly a destination call, from the moment of boarding of a passenger until disembarkation of the passenger at a destination floor or from the moment of loading goods until unloading of goods at a destination floor. Travel parameters of this kind are a speed of an elevator car, an acceleration of the elevator car at the start of a journey and braking of the elevator car on reaching a destination floor, an opening time and a closing time of an elevator car door and a travel shaft door, and adoption of a waiting position of the elevator car (speed equal to zero).

By "loading" of an elevator car there shall be henceforth understood that an elevator car is loaded with passengers and/or goods.

In an advantageous embodiment the control apparatus is provided for the purpose, in the case of simultaneous loading of two elevator cars following one another, to influence at least one travel parameter of a trailing elevator car in order to maintain the defined minimum spacing and/or to maintain the defined maximum spacing of the elevator cars. Advantageously, the maintenance of the defined minimum and/or maximum spacing of elevator cars following one another can thereby be achieved in a particularly simple manner.

Moreover, it is proposed that the control apparatus is provided for the purpose, in the case of simultaneous loading of two elevator cars following one another, to influence at least one travel parameter of a leading elevator car in order to maintain the defined minimum spacing and/or in order to maintain the defined maximum spacing of the elevator cars. Advantageously, the maintenance of the defined minimum and/or maximum spacing of elevator cars following one another can thereby be achieved in particularly simple manner.

In addition, it is proposed that the control apparatus is provided for the purpose, in a case of simultaneous loading of two elevator cars following one another, to move the trailing elevator car into a waiting position in order to maintain the defined minimum spacing and/or to move the leading elevator car into a waiting position in order to maintain the defined maximum spacing of the elevator cars. Advantageously, the maintenance of the defined minimum and/or maximum spacing of elevator cars following one another can thereby be achieved in particularly simple manner.

The adoption of a waiting position of the elevator car can take place with advantage particularly at a floor, preferably with opened travel shaft door and/or car door, or also between two floors. In principle, further travel parameters familiar to the expert are conceivable, which can also be used in combination. Advantageously, maintenance of the defined minimum and/or maximum spacing of elevator cars following one another can thereby be achieved in particularly simple manner.

In a further advantageous embodiment the control apparatus is provided for the purpose, in the case of exclusive loading of the leading one of two elevator cars following one another, to influence at least one travel parameter of the trailing elevator car in order to maintain the defined minimum spacing and/or in order to maintain the defined maximum spacing of the elevator cars, wherein with advantage through an absence of passengers an impairment of a subjective perception of travel comfort can be excluded and thereby the maintenance of the defined minimum and/or maximum spacing of elevator cars following one another can be advantageously achieved in particularly simple manner.

Moreover, it is proposed that the control apparatus is provided for the purpose, in the case exclusive loading of the leading one of two elevator cars following one another, to move the trailing elevator car into a waiting position in order to maintain the defined minimum spacing and/or to maintain the defined maximum spacing of the elevator cars, wherein advantageously through the absence of passengers an impairment of a subjective perception of travel comfort can be excluded and thereby the maintenance of the defined minimum and/or maximum spacing of elevator cars following one another can be advantageously achieved in particularly simple manner.

With particular advantage the control apparatus is provided for the purpose, in the case of exclusive loading of the trailing one of two elevator cars following one another, to influence at least one travel parameter of the leading elevator car in order to maintain the defined minimum spacing and in order to maintain the defined maximum spacing of the elevator cars, wherein advantageously through the absence of passengers an impairment of a subjective perception of travel comfort can be excluded and thereby the maintenance of the defined minimum and/or maximum spacing of elevator cars following one another can advantageously be achieved in particularly simple manner.

In a further advantageous embodiment the control apparatus is provided for the purpose, in the case of exclusive loading of the trailing one of two elevator cars following one another, to move the leading elevator car to a waiting position in order to maintain the defined minimum spacing and in order to maintain the defined maximum spacing of the elevator cars, wherein advantageously through the absence of passengers an impairment of a subjective perception of travel comfort can be excluded and thereby the maintenance of the defined minimum and/or maximum spacing of elevator cars following one another can advantageously be achieved in particularly simple manner.

It is proposed that the control apparatus is provided for the purpose of determining a first common travel direction of the at least two elevator cars in the common travel shaft and of reversing this first travel direction for the at least two elevator cars due to at least one internal destination floor selection and/or external transport request and/or—particularly advantageously—destination call only when all internal destination floor selections and/or all external transport requests and/or all destination calls of the elevator cars in the first travel direction have been processed.

The control apparatus is, in particular, provided for the purpose of serving internal destination floor selections and/or external transport requests and/or destination calls for the elevator cars with priority when they lie in a travel direction currently determined for the elevator cars. By this there shall be understood in this connection, in particular, that the serving of an internal destination floor selection and/or an external transport request and/or a destination call has priority before a change of travel direction of the elevator cars.

By "internal destination floor selection" there is to be understood in this connection, in particular, a selection of a destination floor by a passenger in the elevator car. By "external transport request" there is to be understood in this connection, in particular, a request of an elevator car by actuation of a directionally coupled call button outside the elevator car. By "destination call" there is to be understood in this connection, in particular, a numerical selection of a destination floor, particularly by means of a numerical keyboard and/or by means of speech input, etc., outside the elevator car. By "provided" there is to be understood in this connection, in particular, specially equipped, designed and/or programmed.

The control apparatus is preferably in a situation in which all internal destination floor selections and/or all external transport requests and/or all destination calls of the elevator cars of a travel shaft were processed in a first travel direction, and a then newly arising internal destination floor selection and/or external transport demand and/or destination call, which can be served in the first travel direction, is given priority before an internal destination floor selection and/or external transport request and/or destination call which was already present beforehand and which obliges a reversal of the travel direction. Through serving of the internal destination floor selections and/or external transport requests and/or destination calls in travel direction this can be advantageously maintained, whereby it is with advantage possible to avoid priority conflicts which could lead to undesired stoppage times, which can lead to an improvement in the transport capacity of the elevator installation.

Moreover, it is proposed that the control apparatus is provided for the purpose, in times of increased travel requirement in a first travel direction, to move the elevator cars preferably directly to the starting point of the first travel direction after processing of all internal destination floor selections and/or all external transport requests and/or destination calls of the elevator cars in the first travel direction.

By "time of increased travel requirement in a direction" there is to be understood in this connection, in particular, a time in which a sum, which is formed over a time period of 30 minutes, of mathematical products of a number of the passengers boarding at a floor and a difference of the floor number between a boarding floor and a disembarkation floor differs from zero and, in particular, that an absolute amount of the thus-formed sum corresponds with a proportion of more than 20% of a sum which was formed from absolutely taken products of the number of the passengers boarding at a floor and the difference of the floor number between the boarding floor and the disembarkation floor in the same time period. If the proportion of the absolute amount of the sum is less than 20% of the sum of the absolutely taken products, then the travel requirement shall be termed "evenly distributed in both directions".

By "starting point" of a travel direction there is to be understood, in particular, floors which are located in the uppermost or lowermost quarter of a travel shaft, so that an elevator car which starts from its starting point allocated by the control apparatus can serve at least three-quarters of the length of a travel shaft as a possible travel path. By "preferably directly" there is to be understood in this connection, in particular, that the elevator cars travel to their starting points allocated by the control apparatus without, in the case of at least a first transit, reaction to internal destination floor selections and/or external transport requests and/or destination calls. Through movement of the elevator car to the starting point of a travel direction with increased travel requirement it is advantageously possible to serve increased anticipated internal destination floor selections and/or external transport requests and/or destination calls in this travel direction, which leads to an increase in transport capacity of the elevator installation.

Moreover, it is proposed that the control apparatus is provided for the purpose of controlling the elevator cars arranged in at least one first travel shaft and second travel shaft, whereby advantageously expanded possibilities for co-ordination of travel directions in the at least two travel shafts and thus an increase in the transport capacity of the elevator installation are opened up.

Advantageously, the control apparatus is provided for the purpose, at times of uniformly distributed travel requirement for both travel directions, to determine a first travel direction for the first travel shaft and to determine a travel direction opposite to the first travel direction for the second travel shaft, whereby advantageously a uniform distribution of the elevator cars within the elevator installation can be achieved, which leads to a reduction in waiting times and thus to an increased transport capacity of the elevator installation. For determination of the times of evenly distributed travel requirement for the two travel directions the elevator installation can advantageously be equipped with means for ascertaining the incidence of traffic and with an evaluating unit for statistical evaluation thereof. Determination of times of evenly distributed travel requirement for both travel directions can, in principle, also be carried out by a manual input into the control apparatus.

In an advantageous embodiment the control apparatus is provided for the purpose of controlling elevator cars arranged in at least one first, second and third travel shaft and at times of increased travel requirement in a first travel direction to determine this first travel direction as travel direction for the elevator cars of a plurality of the travel shafts and to determine a travel direction opposite to the first travel direction for the elevator cars of the remaining elevator shafts, whereby it is advantageously possible to serve an increased number of destination calls anticipated in the direction of increased travel requirement, which leads to an increase in the transport capacity of the elevator installation.

In addition, it is proposed that the control apparatus is provided for the purpose of changing the travel directions for the elevator cars in the at least two elevator shafts at least substantially simultaneously. Through an oscillating operation, which arises in this manner, of the elevator cars in the various travel shafts it is advantageously possible to achieve a uniform distribution of the elevator cars within the elevator installation, which leads to a reduction in waiting times and thus to an increased transport capacity of the elevator installation.

By "substantially simultaneous" there is to be understood in this connection, in particular, that the subsequent changes of the travel directions take place within 10 seconds, preferably within 5 seconds and particularly preferably within 3 seconds, after the first change of travel direction of the elevator cars in a first travel shaft.

DESCRIPTION OF THE DRAWINGS

Further advantages are evident from the following description of drawings. Exemplifying embodiments of the invention are illustrated in the drawings. The description and the claims contain numerous features in combination. The expert will advantageously also consider the features individually and combine them into feasible further combinations. There:

DETAILED DESCRIPTION OF THE INVENTION

Figure 1:
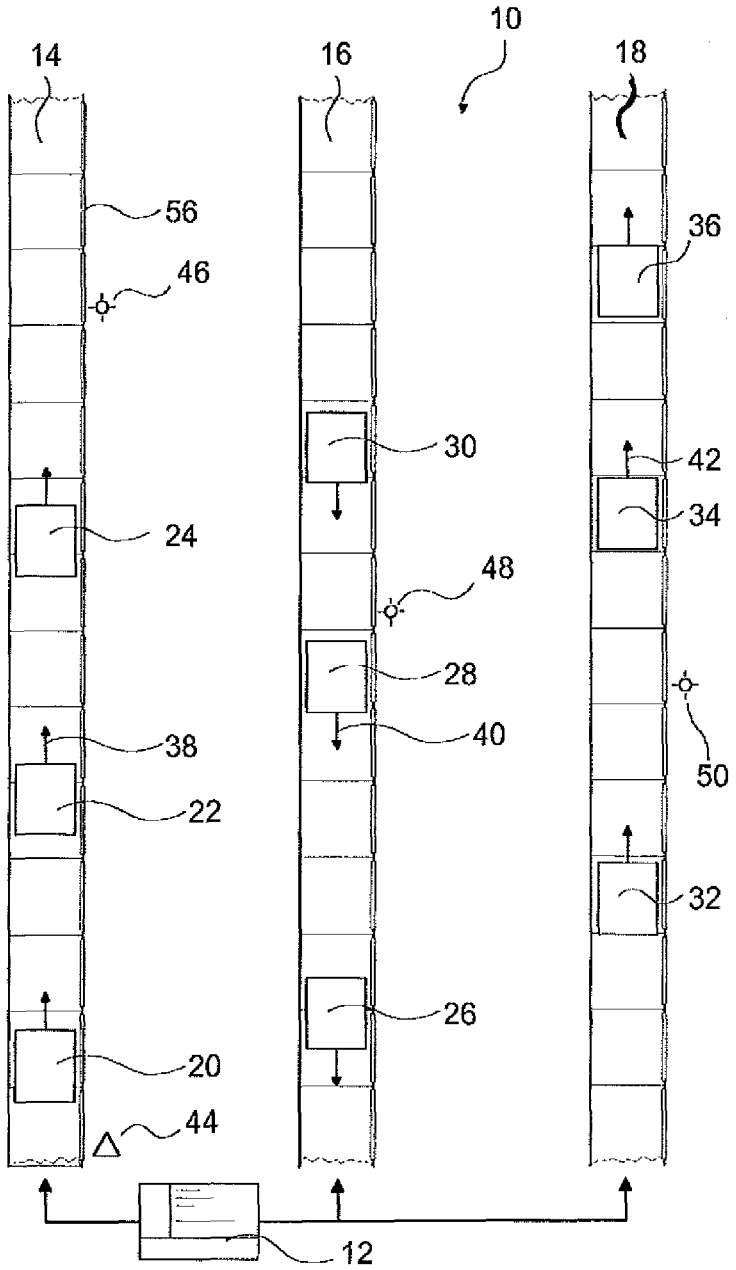
FIG. 1 shows the schematic illustration of an elevator installation with three travel shafts each with three elevator cars.

A detail of an elevator installation 10 with an elevator control and with nine elevator cars 20, 22, 24, 26, 28, 30, 32, 34, 36 is illustrated in FIG. 1. In each instance three of the elevator cars are arranged in a common travel shaft 14, 16 or 18 to be movable independently of one another. The travel shafts 14, 16, 18 have travel shaft doors 56 at each illustrated floor. For reasons of clarity only one travel shaft door 56 is provided with a reference numeral; however, it is to be assumed that all illustrated floors are equipped identically with respect to the travel shaft door 56.

In addition, the elevator control comprises a control apparatus 12 which has determined the upward direction as a first common travel direction 38 of the elevator cars 20, 22, 24 in the first travel shaft 14, the downward direction as a second common travel direction 40 of the elevator cars 26, 28, 30 in the second travel shaft 16 and the upward direction as a third common travel direction 42 of the elevator cars 32, 34, 36 (symbolized in FIG. 1 by corresponding arrows in the elevator cars).

An external transport request 44 in upward direction, two internal destination floor selections 46, 50 in the upward direction and an internal destination floor selection 48 in the downward direction are indicated in the elevator installation 10. The internal destination floor selection 46 lies in the first common travel direction 38 of the elevator cars 20, 22, 24 and the external transport request 44 in upward direction lies oppositely to the travel direction 38 of the elevator cars 20, 22, 24. The control apparatus 12 is provided for the purpose of serving the internal destination floor selection 46, which lies in the first common travel direction 38, with priority. For serving the external transport request 44 a reversal of the travel direction 38 determined by the control apparatus 12 is necessary. This reversal is determined by the control apparatus 12 only when all internal destination floor selections 46 and all external transport requests 44 of the elevator cars 20, 22, 24 and further internal destination floor selections which have been activated from the processing of the internal destination floor selection 46 by boarding passengers—insofar as those selections lie in the first common travel direction 38—have been processed.

The control apparatus 12 is provided for the purpose of determining a defined minimum spacing between each two elevator cars 20, 22, 24, 26, 28, 30, 32, 34, 36 following one another in accordance with the manner taught in the specification EP 0 769 469 B1. A freely selectable maximum spacing was determined in the illustrated example for a magnitude of four floors. However, the determination of the maximum spacing is strongly situation-dependent and depends, for example, on the length of the travel path, particularly the height of the elevator shaft, the number of elevator cars movable on a travel path and the speed at which the elevator cars are moved.

In departure from the above-indicated example the maximum spacing can also be less or more than four floors. Thus, for example, in a building with less than fifteen floors a maximum spacing of two or three floors can be selected. In high buildings with thirty to one-hundred floors a larger maximum spacing of five to fifteen or more floors is also determinable.

The maximum spacing between a leading and a following elevator car is preferably at most 75% of the spacing between the leading elevator car and an obstacle lying behind the following elevator car. The lower end of an elevator shaft or a further, following elevator car, for example, represents such an obstacle. In a further preferred variant the maximum spacing is at most 50%, 30%, 25% or 10% of this spacing.

Moreover, in the case of a higher travel speed of an elevator car a greater maximum spacing can preferably also be determined, since, for example, a following empty elevator car catches up a leading elevator car, which stops at a floor, more quickly.

The control apparatus 12 is provided for the purpose of maintaining the defined minimum spacing and the defined maximum spacing between the elevator cars 20 and 22 following one another as well as the elevator cars 22 and 24 following one another in the first travel shaft 14. The same applies to the elevator cars 26 and 28 following one another and the elevator cars 28 and 30 in the second travel shaft 16 and also to the elevator cars 32 and 34 following one another and the elevator cars 34 and 36 in the third travel shaft 18.

The minimum spacing and the maximum spacing of the elevator cars 20, 22, 24 moving in the first travel shaft 14 is currently maintained for the elevator cars 20, 22, 24 so that no measures have to be undertaken by the control apparatus 12. The elevator cars 20, 22, 24 are moved at the same speed in the determined travel direction 38.

The minimum spacing is currently just achieved for the elevator cars 28 and 30 of the second travel shaft 16. The control apparatus 12 has several possibilities of corrective action. Under the assumption that the two elevator cars 28, 30 transport passengers, the control apparatus 12 can, for maintenance of the defined minimum spacing, influence a travel parameter of the trailing elevator car 30 and reduce the speed of the elevator car 30 until the minimum spacing is achieved. Another possibility consists of letting the elevator car 30 after a stop at the floor with the internal destination floor selection 48, which—lying in travel direction 40—is preferentially served, depart at an acceleration which is slower than that filed in the control apparatus 12 for normal departure. Alternatively, the control apparatus 12 can, after a stop of the trailing elevator car 30 at the floor with the internal destination floor selection 48, increase the opening and/or closing times for the elevator car door and/or the travel shaft door 56 of the floor relative to the times filed in the control apparatus 12 for a normal stop. Alternatively, the control apparatus 12 can move the trailing elevator car 30 to a waiting position until the minimum spacing for the elevator car 28 is maintained.

The spacing of the elevator cars 32 and 34, which follow one another, of the third elevator shaft 18 is somewhat greater than the maximum spacing. The two elevator cars 32 and 34 transport passengers. The control apparatus 12 is provided for the purpose of influencing a travel parameter of the leading elevator car 34 in order to maintain the defined minimum spacing and reduces the speed of the leading elevator car 34, or the control apparatus 12 lets the leading elevator car 34, after a stop, depart at an acceleration which is smaller than that filed in the control apparatus 12 for a normal departure. Moreover, the control apparatus 12 can, during a stop of the elevator car 34, increase the opening and/or closing times for the elevator car door and/or the travel shaft door 56 of the floor relative to the times filed in the control apparatus 12 for a normal stop. Alternatively, the control apparatus 12 can move the elevator car 34 to a waiting position until the maximum spacing for the elevator car 32 is maintained.

If in the elevator cars 28 and 30 following one another only the leading elevator car 28 transports passengers then the control apparatus 12 is provided for the purpose of influencing at least one travel parameter of the trailing elevator car 30 in order to maintain the defined minimum spacing between the elevator cars 28 and 30. The control apparatus 12 moves the elevator car 30 into a waiting position, wherein a floor with a high probability of boarding is preferred. If the maximum spacing between the leading elevator car 28 and the trailing elevator car 30 is achieved, then the control apparatus 12 is provided for the purpose of letting the trailing elevator car 30 follow, travelling in an empty state, the leading elevator car 28 in order to maintain the maximum spacing.

In the third travel shaft 18 the trailing elevator car 34 with passengers and the leading elevator car 36 without passengers move in the upward direction determined as travel direction 42 by the control apparatus 12. In this situation the control apparatus 12 is, for maintenance of the defined minimum spacing between the elevator cars 34 and 36, provided for the purpose of influencing at least one travel parameter of the leading elevator car 36. For that purpose the control apparatus 12 moves the elevator car 36, travelling in an empty state, in front of the trailing elevator car 34 in the travel direction 42. Alternatively, the control apparatus 12 can influence at least one travel parameter of the leading elevator car 36 and move the elevator car 36 to a waiting position, wherein a floor with a high probability of boarding is preferred.

Figure 2:
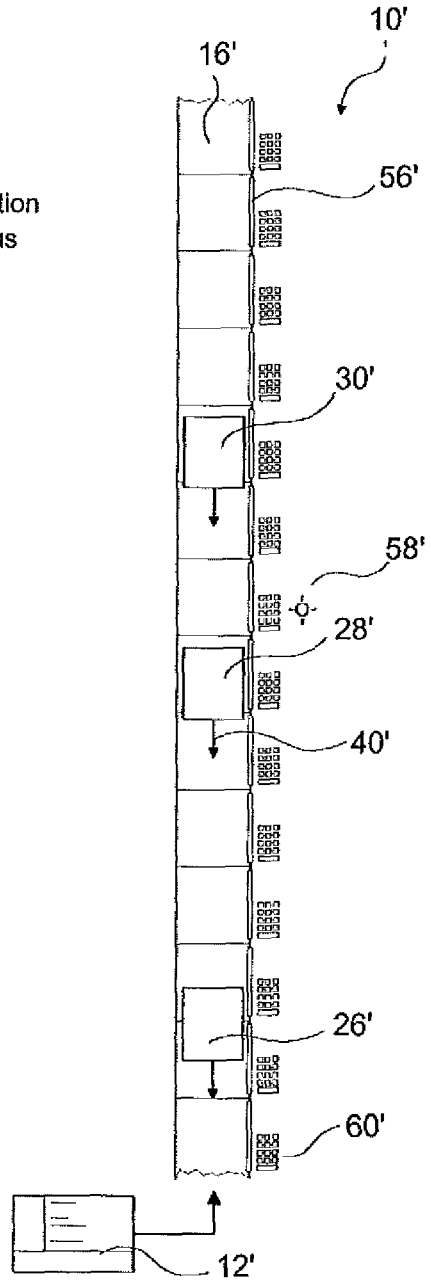
FIG. 2 shows the schematic illustration of an elevator installation with one travel shaft and three elevator cars.

In the exemplifying embodiment, which is illustrated in FIG. 2, of an elevator installation 10' with an elevator control which is equipped in each floor with a numerical keyboard 60' for the input of destination calls 58' three elevator cars 26', 28', 30' can be moved in a travel shaft 16' independently of one another. The control apparatus 12' contains manually input data with respect to times of evenly distributed travel requirement as well as with respect to times of increased travel requirement in the upward direction in the morning and in the downward direction in the evening.

There is currently a time of increased travel requirement in the upward direction for the elevator installation 10'. A destination call 58' for a floor lying above the elevator cars 26', 28', 30' is present. The control apparatus 12' is provided for the purpose, in times of increased travel requirement in a first travel direction 40', of moving the elevator cars 26', 28', 30' preferably directly to the starting point of the first travel direction 40' after processing of all destination calls 58' in the first travel direction 40'. In the illustrated situation the elevator cars 26', 28', 30' have already processed their destination calls in the upward direction.

The control apparatus 12' now moves the elevator cars 26', 28', 30', which are travelling in empty state, to their determined starting points for the upward direction without reacting to the destination call 58' to one of the upper floors. This is served only when the elevator cars 26', 28', 30', starting from the start points thereof, have processed the then present destination calls 58'. If the existing destination call 58' were to be directed to a floor disposed below the elevator cars 26', 28', 30', then the control apparatus 12' is provided for the purpose of moving the elevator cars 26', 28', 30' to the start points thereof for the upward direction and in that case going past the floor with the destination call 58' at least once without stopping. The destination call 58' could be served, for example, only on the occasion of a second travel of the elevator cars 26', 28', 30' past in downward direction.

Manually input data with respect to the times of evenly distributed travel requirement as well as with respect to times of increased travel requirement in the upward direction in the morning and in the downward direction in the evening are similarly assumed for the control apparatus 12 of the exemplifying embodiment of FIG. 1. In the case of elevator installations 10 with several travel shafts 14, 16, 18 the control apparatus 12 is provided for execution of further measures of co-ordination of the travel directions in order to take into consideration times with increased travel requirement in a travel direction 38, 40, 42.

The situation, which is illustrated in FIG. 1, of the elevator installation 10 with three travel shafts 14, 16, 18 corresponds with a control of the elevator cars 20, 22, 24, 26, 28, 30, 32, 34, 36 at a time of increased travel requirement in the upward direction. The control apparatus 12 has determined the upward direction as travel direction 38, 40 of the elevator cars 20, 22, 24, 32, 34, 36 for a plurality of the travel shafts 14, 16, 18, namely for the travel shafts 14 and 18. The elevator cars 26, 28, 30 in the travel shaft 16 are moved by the control apparatus 12 in the opposite travel direction 40, i.e. the downward direction.

The control apparatus 12 determines, at times of evenly distributed travel requirement, a travel direction 38 for the elevator cars 20, 22, 24 of the first travel shaft 14 and an apposite travel direction 40 for the elevator cars 26, 28, 30 of the second travel shaft 16. If all internal destination floor selections 46, 48, 50 and/or all external transport requests 44 of the elevator cars 20, 22, 24 in the travel direction 38 have been processed, but if in the travel direction 40 there are still internal destination floor selections 46, 48, 50 and/or external transport requests 44 of the elevator cars 26, 28, 30 for processing, then the control apparatus 12 moves the elevator cars 20, 22, 24 to a waiting position from which they can process further internal destination floor selections 46, 48, 50 and/or external transport requests 44 in the travel direction 38.

When the internal destination floor selections 46, 48, 50 and/or external transport requests 44 of the elevator cars 26, 28, 30 in the travel direction 40 and the internal destination floor selections 46, 48, 50 and/or external transport requests 44 of the elevator cars 20, 22, 24 in the travel direction 38 have been processed, the control apparatus 12 reverses the travel direction 38 of the elevator cars 20, 22, 24 of the first travel shaft 14 and the travel direction 40 of the elevator cars 26, 28, 30 of the second travel shaft 16 within three seconds. Through this matching in terms of time of the elevator cars 20, 22, 24, 26, 28, 30 in the travel shafts 14, 16 an oscillating operation arises which increases the probability of the elevator cars 20, 22, 24, 26, 28, 30 being uniformly distributed over the floors. The travel direction 42 of the elevator cars 32, 34, 36 of the third travel shaft 18 is synchronized by the control apparatus 12 at times of evenly distributed travel requirement in accordance with the respective number of internal destination floor selections 46, 48, 50 which are present and/or external transport requests 44 in the described manner with one of the two travel directions 38, 40 of the two other travel shafts 14, 16.

At times of increased travel requirement in a travel direction 38 the control apparatus 12 moves the elevator cars 32, 34, 36 of the third travel shaft 18 so that the common travel direction 42 thereof is also the travel direction 38 with increased travel requirement. If all internal destination floor selections 46, 48, 50 and/or external transport requests 44 of the elevator cars 20, 22, 24 in the travel direction 38 and all internal destination floor selections 46, 48, 50 and/or external transport requests 44 of the elevator cars 32, 34, 36 in the same travel direction 42 have been processed, but internal destination floor selections 46, 48, 50 and/or external transport requests 44 of the elevator cars 26, 28, 30 in the travel direction 40 are still to be processed, then the control apparatus 12 moves the elevator cars 20, 22, 24, 32, 34, 36 into a waiting position from which they can process further internal floor selections 46, 48, 50 and/or external transport requests 44 in the travel direction 38, 42. When the internal destination floor selections 46, 48, 50 and/or external transport requests 44 of the elevator cars 26, 28, 30 in the travel direction 40 and the internal destination floor selections 46, 48, 50 and/or external transport requests 44 of the elevator cars 20, 22, 24, 32, 34, 36 in the travel direction 38, 42 have been processed, the control apparatus 12 reverses the travel direction 38 of the elevator cars 20, 22, 24 of the first travel shaft 14, the travel direction 40 of the elevator cars 26, 28, 30 of the second travel shaft 16 and the travel direction 42 of the elevator cars 20, 22, 24 of the first travel shaft 14 within three seconds.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator control of an elevator installation with at least two elevator cars that move independently of one another in a common travel shaft, comprising:

a first elevator car movable in the common travel shaft;

a second elevator car movable in the common travel shaft; and a control apparatus maintaining the first and second elevator cars following one another at a spacing between a predefined minimum spacing and a predefined maximum spacing.

2. The elevator control according to claim 1 wherein the control apparatus during loading of the first elevator car influences at least one travel parameter of the second elevator car for maintenance of the predefined minimum spacing and for maintenance of the predefined maximum spacing.

3. The elevator control according to claim 1 wherein the control apparatus during simultaneous loading of the first and second elevator cars influences at least one travel parameter of a trailing one of the first and second elevator cars for maintenance of the predefined minimum spacing and for maintenance of the predefined maximum spacing.

4. The elevator control according to claim 1 wherein the control apparatus during simultaneous loading of the first and second elevator cars influences at least one travel parameter of a leading one of the first and second elevator cars for maintenance of the predefined minimum spacing and for maintenance of the predefined maximum spacing.

5. The elevator control according to claim 1 wherein the control apparatus during simultaneous loading of the first and second elevator cars moves a trailing one of the first and second elevator cars to a waiting position for maintenance of the predefined minimum spacing and moves a leading one of the first and second elevator cars to a waiting position for maintenance of the predefined maximum spacing.

6. The elevator control according to claim 1 wherein the control apparatus during exclusive loading of a leading one of the first and second elevator cars influences at least one travel parameter of a trailing one of the first and second elevator cars for maintenance of the predefined minimum spacing and for maintenance of the predefined maximum spacing.

7. The elevator control according to claim 1 wherein the control apparatus during exclusive loading of a leading one of the first and second elevator cars moves a trailing one of the first and second elevator cars to a waiting position for maintenance of the predefined minimum spacing and for maintenance of the predefined maximum spacing.

8. The elevator control according to claim 1 wherein the control apparatus during exclusive loading of a trailing one of the first and second elevator cars influences at least one travel parameter of a leading one of the first and second elevator cars for maintenance of the predefined minimum spacing and for maintenance of the predefined maximum spacing.

9. The elevator control according to claim 1 wherein the control apparatus during exclusive loading of a trailing one of the first and second elevator cars moves a leading one of the first and second elevator cars to a waiting position for maintenance of the predefined minimum spacing and for maintenance of the predefined maximum spacing.

10. The elevator control according to claim 1 wherein the control apparatus receives at least one of internal destination floor selections, external transport requests destination calls and responds by determining a first common travel direction of the first and second elevator cars in the common travel shaft and reversing the first common travel direction of the first and second elevator cars in response to at least another one of the internal destination floor selections, external transport requests and destination calls only when all internal destination floor selections, external transport requests and destination calls being served by the first and second elevator cars in the first common travel direction have been processed.

11. The elevator control according to claim 1 wherein the control apparatus during times of increased travel requirement in a first direction moves the first and second elevator cars directly to a starting point of the first travel direction after processing of all internal destination floor selections, external transport requests and destination calls in the first travel direction.

12. A method of controlling an elevator installation having at least first and second elevator cars that move independently in a common travel shaft comprising the steps of:

providing an elevator control apparatus; and operating the control apparatus to control movement of the first and second elevator cars in the common travel shaft to maintain a spacing of the first and second elevator cars between a predefined minimum spacing and a predefined maximum spacing.

13. The method according to claim 12 wherein during loading of the first elevator car influencing at least one travel parameter of the second elevator car for maintenance of the predefined minimum spacing and for maintenance of the predefined maximum spacing.

* * * * *